US006626740B2

(12) United States Patent
Baker, III et al.

(10) Patent No.: US 6,626,740 B2
(45) Date of Patent: Sep. 30, 2003

(54) SELF-LEVELING PADS AND METHODS RELATING THERETO

(75) Inventors: Arthur Richard Baker, III, Kennett Square, PA (US); Russell A. Walls, Jr., Elkton, MD (US); Stephen P. Carter, Bear, DE (US); Jeffrey J. Hendron, Elkton, MD (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 09/742,953

(22) Filed: Dec. 21, 2000

(65) Prior Publication Data

US 2002/0004357 A1 Jan. 10, 2002

Related U.S. Application Data

(60) Provisional application No. 60/171,907, filed on Dec. 23, 1999, and provisional application No. 60/226,998, filed on Aug. 22, 2000.

(51) Int. Cl.[7] ..... B24D 11/00

(52) U.S. Cl. ..... 451/41; 451/259; 451/526; 451/538

(58) Field of Search ..... 451/36, 37, 41, 451/55, 59, 60, 65, 259, 313, 397, 398, 461, 526, 533, 534, 537, 538, 539

(56) References Cited

U.S. PATENT DOCUMENTS

| | | | | | |
|---|---|---|---|---|---|
| 3,067,482 | A | | 12/1962 | Hollowell | |
| 3,067,483 | A | | 12/1962 | Hollowell | |
| 3,284,274 | A | | 11/1966 | Hulslander et al. | |
| 3,504,457 | A | | 4/1970 | Jacobsen et al. | |
| 4,511,605 | A | | 4/1985 | McCartney | |
| 4,728,552 | A | | 3/1988 | Jensen, Jr. | |
| 4,927,432 | A | | 5/1990 | Budinger et al. | |
| 5,212,910 | A | * | 5/1993 | Breivogel et al. | 451/287 |
| 5,573,444 | A | * | 11/1996 | Ryoke et al. | 451/28 |
| 5,858,140 | A | * | 1/1999 | Berger et al. | 156/244.27 |
| 5,876,269 | A | * | 3/1999 | Torii | 451/288 |
| 6,017,265 | A | * | 1/2000 | Cook et al. | 451/41 |
| 6,022,268 | A | * | 2/2000 | Roberts et al. | 451/41 |
| 6,077,153 | A | * | 6/2000 | Fujita et al. | 451/259 |
| 6,089,966 | A | * | 7/2000 | Arai et al. | 451/533 |
| 6,123,609 | A | * | 9/2000 | Satou | 451/285 |
| 6,132,292 | A | * | 10/2000 | Kubo | 216/88 |
| 6,177,026 | B1 | * | 1/2001 | Wang et al. | 252/79.1 |
| 6,217,434 | B1 | * | 4/2001 | Roberts et al. | 451/41 |
| 6,293,852 | B1 | * | 9/2001 | Roberts et al. | 451/41 |
| 6,306,021 | B1 | * | 10/2001 | Masumura et al. | 451/287 |
| 6,328,634 | B1 | * | 12/2001 | Shen et al. | 451/287 |
| 6,332,832 | B1 | * | 12/2001 | Suzuki | 451/41 |

FOREIGN PATENT DOCUMENTS

| | | | | |
|---|---|---|---|---|
| EP | 0 873 821 A | | 10/1998 | |
| EP | 1 057 841 A | | 12/2000 | |
| JP | 409057608 A | * | 3/1997 | B24B/37/00 |
| JP | 411156701 A | * | 6/1999 | B24B/37/00 |
| WO | WO98 47662 A | | 10/1998 | |
| WO | WO99 24218 A | | 5/1999 | |

* cited by examiner

*Primary Examiner*—Lee D. Wilson
*Assistant Examiner*—David B. Thomas
(74) *Attorney, Agent, or Firm*—Gerald J. Kita; Blake T. Biederman

(57) ABSTRACT

A polishing pad having a soft layer with a porous structure impregnated with a relatively hard material that locally deforms irreversibly under polishing pressure to a substantially flat polishing pad surface.

10 Claims, 3 Drawing Sheets

Comparison of Removal Rates

SELF-LEVELING PADS AND METHODS RELATING THERETO

This utility application claims the benefit of U.S. Provisional Application No. 60/171,907 filed on Dec. 23, 1999 and U.S. Provisional Application No. 60/226,998 filed on Aug. 22, 2000.

BACKGROUND OF THE INVENTION

U.S. Pat. No. 3,504,457 is directed to a composite or multi-layer pad which includes a foam polyurethane polishing layer, an intermediate porous layer, and a nitrile rubber layer. However, this type of pad generally does not uniformly planarize the substrate being polished.

SUMMARY OF THE INVENTION

The pad of this invention preferably comprises a relatively soft layer with a porous structure, preferably microporous, wherein the soft layer is impregnated with a relatively hard material. Under polishing pressures, the relatively hard material preferably deforms locally and irreversibly to a substantially flat polishing pad surface resulting in a polished substrate surface with relatively high planarity and substantially low form error. In an embodiment, the soft layer comprises a polymeric material having a glass transition temperature up to about 0, 5, 10, 15, 20, 25, 30, 35, 40, 45 or 50° C., and the hard material comprises a polymeric material having a glass transition temperature in a range of about 25° C. to about 175° C. including 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, or 175° C. In an embodiment, the porous structure is self-supporting or in the alternative is coated onto a substrate, preferably flexible.

BRIEF DESCRIPTION OF THE DRAWING

Embodiments of the invention are described by way of example with reference to the accompanying drawings.

DETAILED DESCRIPTION OF THE PREFERRED EMBODIMENTS

High precision chemical-mechanical polishing (CMP) is often employed in the manufacture of integrated circuits and memory disks. The CMP process is discussed in detail in "*Chemical Mechanical Planarization of Microelectronic Materials*", J. M. Steigerwald, S. P. Murarka, R. J. Gutman, Wiley, 1997, which is incorporated herein by reference for all useful purposes. An ideal polished substrate surface has the following characteristics: low waviness (or low form error); low flatness; low roughness; no raised edge; low dub-off; and minimal scratches. Variations in polishing pad characteristics often result in poor characteristics of the substrate being polished. These variations can include high spots on the polishing pad surface and bubbles under the polishing pad, often resulting in a non-uniform polishing pad surface and inconsistent polishing performance of the polishing pad during CMP. Thus, a need exists for polishing pads that exhibit consistent polishing behavior.

Figure 1A:
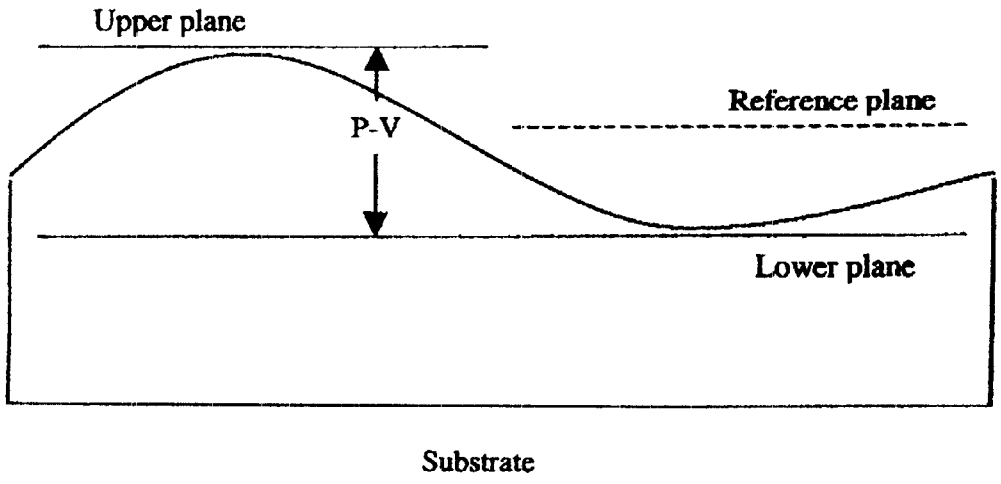
FIG. 1A is a view of a surface profile of an unpolished substrate.
Figure 1B:
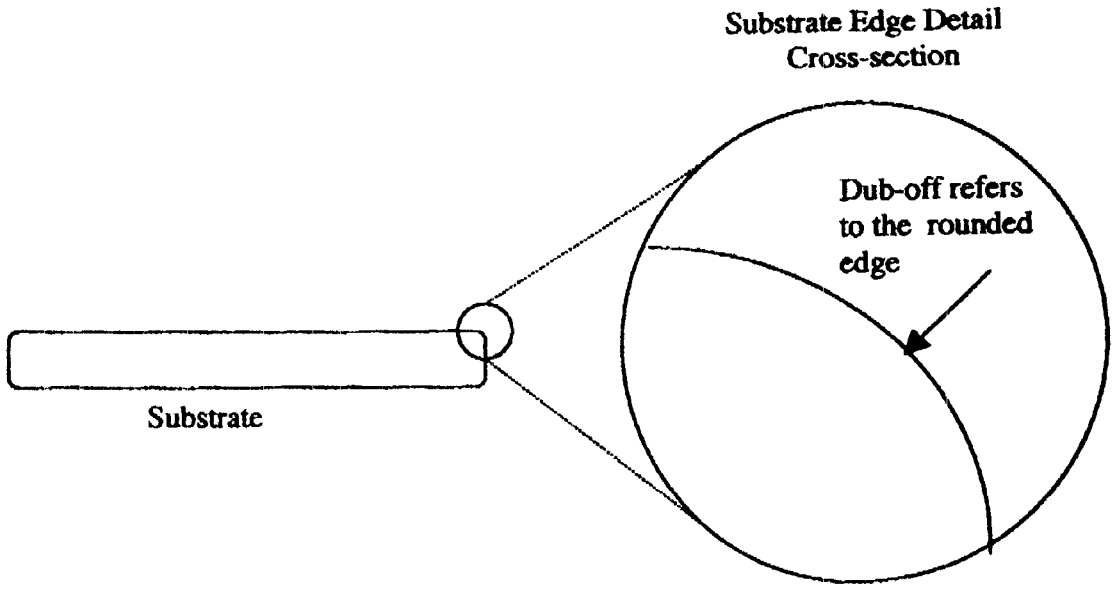
FIG. 1B illustrates dub-off which generally should be minimized during chemical mechanical polishing of substrates.

The substrate surface can be characterized by surface features that repeat at a specified distance or spatial wavelength. The overall shape characteristics of the substrate surface can be collectively referred to as "form" of the substrate surface. High and low spots on the substrate surface are often linked to form error, since they represent peaks and valleys on the substrate surface relative to an imaginary reference plane (corresponding to an ideally flat surface), as illustrated in FIG. 1A. Flatness is a measure of the peak to valley range from the imaginary reference plane over long spatial wavelengths. Another parameter to be minimized during CMP is dub-off. Dub-off (also referred to as roll-off in the memory disk industry) is the "negative deviation from the nominal surface extending from the chamfer and continuing to the edge of the flyable zone (International Disk Equipment and Materials Association)", illustrated in FIG. 1B. Two measurements are used to quantify dub-off: peak and radius of curvature. The peak measurement identifies the maximum distance of the polished surface from a fit line designated by the instrument technician. Similarly, the radius of curvature measurement is the distance from the surface being measured to the center of curvature.

Hardness or compression modulus of the polishing pad is a measure of the degree to which the pad material deforms when subjected to pressure or downforce during CMP. Hard polishing pads generally yield a polished substrate surface with good planarization and low form error. However, hard polishing pads also scratch the substrate surface and result in a polished substrate surface of poor quality. Soft polishing pads, such as poromeric pads, and "foam" type pads, generally exhibit excellent surface finish with low levels of scratching, low roughness and good removal rates. However, soft polishing pads result in poor planarization and high waviness of the polished substrate surface. The present invention combines desirable characteristics of hard and soft polishing pads resulting in a finished polished substrate surface with low roughness, low waviness, low dub-off and minimal scratching.

The pad of this invention comprises a soft layer with a porous structure impregnated with a hard material. Under polishing pressure, the hard material locally deforms irreversibly to a substantially flat polishing pad surface resulting in a polished substrate surface with relatively high planarity and substantially low form error. In an embodiment, the soft layer comprises a polymeric material having a glass transition temperature up to about 0, 5, 10, 15, 20, 25, 30, 35, 40, 45, or 50° C. and the relatively hard material comprises a polymeric material having a glass transition temperature in a range of about 25° C. to 175° C., including 25, 30, 35, 40, 45, 50, 55, 60, 65, 70, 75, 80, 85, 90, 95, 100, 105, 110, 115, 120, 125, 130, 135, 140, 145, 150, 155, 160, 165, 170 or 175° C. In an embodiment, the relatively hard material is a polymeric material having a glass transition temperature in a range of about 40° C. to about 110° C. Typical temperatures observed during CMP are in a range of about 20° C. to 40° C. The relatively hard polymeric material has a glass transition temperature relatively higher than the ambient temperature during polishing making it brittle and readily friable. Thus, the hard polymeric material is capable of being locally deformed irreversibly to a substantially flat polishing pad surface. In another embodiment, the soft layer is coated onto a flexible substrate. In an embodiment, the porous structure of the soft layer enables movement of polishing fluid or slurry during CMP. This ability to transport the polishing fluid or slurry enables uniform wetting of the polishing pad of this invention resulting in consistent removal rates.

The pad of this invention is capable of being locally deformed irreversibly to a substantially flat polishing pad surface when the readily friable hard material cracks at the high spots under polishing pressures resulting in a substantially flattened polishing pad surface. Thus, the pad of this invention has a "self-leveling" characteristic or nature which results in a polishing pad that is tolerant to mounting irregularities and can improve waviness and flatness of the polished substrate surface.

The soft material has a porous structure that is either self-supporting or is coated onto a flexible substrate such as a flexible metal film, polyester film, or a foam. The soft layer is impregnated with a hard, friable material. During polishing the substrate being polished (workpiece) flexes the polishing pad so that the hard material cracks and breaks down in any high spots on the polishing pad surface. Further down in the pad surface the flexing is insufficient to cause any disruption to the hard material. Thus, the polishing pad surface becomes substantially flat during polishing creating a "self-leveling" surface. The soft layer controls the final finish of the polished substrate surface while the hard material controls the form error (waviness) of the polished substrate surface.

The "self-leveling" characteristic of the polishing pad of this invention results in a flat polishing pad surface, improving product yields during CMP by reducing aberrations in the surface of the polished substrate or workpiece. Thus, the pad of this invention has the following advantages when used for CMP: 1) elimination of inconsistencies during pad manufacturing and inconsistencies during the process of mounting the polishing pad on a platen of a polishing machine; 2) improved long wavelength roughness; and 3) higher removal rate with minimal scratching of the polished substrate surface. The pad of this invention is used to polish semiconductor devices, silicon wafers, glass disks, LCD screens, memory disks, or the like.

In an embodiment, the flexible substrate used in a pad according to this invention has a thickness in a range of about 100 $\mu$m to about 500 $\mu$m. In another embodiment, the flexible substrate is a felt substrate having a thickness in a range of about 250 $\mu$m to 6,400 $\mu$m. In an embodiment, the soft layer has a porous structure with a thickness in a range of about 200 to 12,000 $\mu$m.

Exemplary flexible substrates that can be used in the polishing pad of this invention include flexible metal sheets such aluminum foil, stainless steel sheets and the like; flexible films such polyester film; and formed (molded, embossed, or micro-replicated) polymeric substrates. In an embodiment, the flexible substrate is polyethylene terephthalate (PET). In another embodiment, the flexible substrate is a felt substrate with fibers made of polytetrafluoroethylene, polypropylene, polyamide and the various nylons. For ease of processing, fetters prefer to use fiber blends in non-woven felt webs in which fibers having at least two different denier are preferred. The denier generally ranges from less than 1.0 to about 6.0 denier. The fibrous felt webs are typically formed into rolls for further manufacturing.

U.S. Pat. No. 4,511,605 describes a process for producing polishing pads by fully impregnating a fibrous batt with an aqueous polyurethane dispersion, coagulating the polyurethane dispersion, and drying the impregnated batt. This patent also describes the addition of colloidal silica to the polyurethane dispersion to increase the density of the impregnated material.

In an embodiment, the soft layer comprises a polymeric material that has a porous structure and is made of a polyurethane or a polyurea. An example of a polyurethane is a polyetherurethane that is the reaction product of an alkene polyol and an organic polyisocyanate selected from the group of aliphatic, cycloaliphatic or aromatic diisocyanates. Another example of a polyurethane is a polyesterurethane that is a reaction product of a hydroxy functional polyester and an organic polyisocyanate selected from the group of aliphatic, cycloaliphatic or aromatic diisocyanates. Examples of polyisocyanates are aromatic diisocyanates such as toluene diisocyanate and diphenylmethane diisocyanate and aliphatic diisocyanates such as methylene diisocyanate. An exemplary polyetherurethane is the reaction product of a mixture of polyols, e.g. ethylene glycol, propylene glycol and butanediol and 4,4-diphenylmethane diisocyanate. An exemplary polyesterurethane is the reaction product of dihydroxy polybutylene adipate and methylene bis (4-phenyl isocyanate).

The hard friable material used to impregnate the soft layer is made of polymeric materials, ceramics, inorganic oxides, nitrides, carbides, diamond, metal oxides, metal powders, and combinations or mixtures thereof. Metal oxides for use in this invention include alumina, ceria, germania, silica, titania, zirconia and the like. Metal powders include tin, copper, zinc and the like. In an embodiment, the hard material is a polymeric material having a glass transition temperature ($T_g$) of about 25 to about 175° C. The high glass transition temperature, above the ambient temperatures normally observed during CMP, of the hard polymeric material makes it hard and brittle. An exemplary hard polymeric material is a polyurethane/polyacrylate composite polymer. In an embodiment, the hard polymeric material is composed of different polymeric segments such that its $T_g$ is in a range of about 25° C. to about 175° C.

Polyurethanes and polyacrylates are examples of useful polymer chemistries for the pad of this invention. Examples of other polymeric materials include polycarbonate, polysulfone, epoxy, nylon, isocyanurate, polyether, polyester, polyether-polyester copolymers, acrylic polymers, polymethyl methacrylate, polyethylene imine, polyether sulfone, polyketones, polyether imide, polyvinyl alcohol, polyamide and derivatives thereof. Non water-soluble polymers formed by the polymerization of the following classes of monomers are suitable for use as the "polymeric material" in a polishing pad according to this invention. The following lists of monomers are exemplary and are provided to illustrate the chemistries for use in various embodiments of the pad according to this invention.

Sulfonic acid monomers such as 2-acrylamido-2-methyl-1-propanesulfonic acid, 2-methacrylamido-2-methyl-1-propanesulfonic acid, 3-methacrylamido-2-hydroxy-1-propanesulfonic acid, allylsulfonic acid, allyloxybenzenesulfonic acid, 2-hydroxy-3-(2-propenyloxy) propanesulfonic acid, 2-methyl-2-propene-1-sulfonic acid, styrene sulfonic acid, vinyl sulfonic acid, 3-sulfopropyl acrylate, and 3-sulfopropyl methacrylate.

Amine-containing monomers suitable for use in the present invention include, for example, amide monomers such as dialkylaminoalkyl acrylamides or methacrylamides (for example, dimethylaminopropyl methacrylamide), N,N-bis-(dimethylaminoalkyl) acrylamides or methacrylamides, N-β-aminoethyl acrylamide or methacrylamide, N-(methylamino-ethyl)acrylamide or methacrylamide, aminoalkylpyrazine acrylamides or methacrylamides; acrylic ester monomers such as dialkylaminoalkyl acrylates or methacrylates (for example, dimethylaminoethyl acrylate or methacrylate), β-aminoethyl acrylate or methacrylate, N-(n-butyl)-4-aminobutyl acrylate or methacrylate, methacryloxyethoxyethylamine, and acryloxypropoxypropoxypropylamine; vinyl monomers such as vinyl pyridines; aminoalkyl vinyl ethers or sulfides such as β-aminoethyl vinyl ether, β-aminoethyl vinyl sulfide, N-methyl-β-aminoethyl vinyl ether or sulfide, N-ethyl-β-aminoethyl vinyl ether or sulfide, N-butyl-β-aminoethyl vinyl ether or sulfide, and N-methyl-3-aminopropyl vinyl ether or sulfide; N-acryloxyalkyloxazolidines and N-acryloxyalkyltetrahydro-1,3-oxazines such as oxazolidinylethyl methacrylate, oxazolidinylethyl acrylate, 3-(γ-methacryloxypropyl)tetrahydro-1,3-oxazine, 3-(β-methacryloxyethyl)-2,2-pentamethylene-oxazolidine, 3-(β-methacryloxyethyl)-2-methyl-2-propyl-oxazolidine, N-2-(2-acryloxyethoxy)ethyl-oxazolidine, N-2-(2-methacryloxyethoxy)-ethyl-5-methyl-oxazolidine, 3-[2-(2-methacryloxyethoxy)ethyl]-2,2 dimethyloxazolidine, N-2-(2-acryloxyethoxy)ethyl-5-methyl-oxazolidine, 3-[2-(methacryloxyethoxy)-ethyl]-2-phenyl-oxazolidine, N-2-(2-methacryloxyethoxy)ethyl-oxa-zolidine, and 3-[2-(2-methacryloxyethoxy)ethyl]-2,2-pentamethylene-oxazolidine.

Another class of suitable monoethylenically unsaturated monomers is nitrogen-containing ring compounds, for example, vinylpyridine, 2-methyl-5-vinylpyridine, 2-ethyl-5-vinylpyridine, 3-methyl-5-vinylpyridine, 2,3-dimethyl-5-vinylpyridine, 2-methyl-3-ethyl-5-vinylpyridine, methyl-substituted quinolines and isoquinolines, 1-vinylimidazole, 2-methyl-1-vinylimidazole, N-vinylcaprolactam, N-vinylbutyrolactam and N-vinylpyrrolidone.

Another class of monomers is monoethylenically unsaturated monomers comprising ethylene and substituted ethylene monomers, for example: α-olefins such as propylene, isobutylene and long chain alkyl α-olefins (such as $(C_{10}–C_{20})$alkyl α-olefins); vinyl alcohol esters such as vinyl acetate and vinyl stearate; vinyl halides such as vinyl chloride, vinyl fluoride, vinyl bromide, vinylidene chloride, vinylidene fluoride and vinylidene bromide; vinyl nitrites such as acrylonitrile and methacrylonitrile; methacrylic acid and its derivatives such as corresponding amides and esters; maleic acid and its derivatives such as corresponding anhydride, amides and esters; fumaric acid and its derivatives such as corresponding amides and esters; itaconic and citraconic acids and their derivatives such as corresponding anhydrides, amides and esters.

In an embodiment, the polymer used in this invention is combined with another polymer derived from monoethylenically unsaturated monomers such as vinylaromatic monomers that include, for example, styrene, α-methylstyrene, vinyltoluene, ortho-, meta- and para-methylstyrene, ethylvinylbenzene, vinylnaphthalene and vinylxylenes. The vinylaromatic monomers also include their corresponding substituted counterparts, for example, halogenated derivatives, that is, containing one or more halogen groups, such as fluorine, chlorine or bromine; and nitro, cyano, alkoxy, haloalkyl, carbalkoxy, carboxy, amino and alkylamino derivatives.

Other polymers for use in this invention include poly (meth)acrylates derived from the polymerization of alkyl (meth)acrylate monomers. Exemplary alkyl methacrylate monomers, where the alkyl group contains 1 to 6 carbon atoms (also called "low-cut" alkyl methacrylates), are: methyl methacrylate (MMA), methyl and ethyl acrylate, propyl methacrylate, butyl methacrylate (BMA) and butyl acrylate (BA), isobutyl methacrylate (IBMA), hexyl and cyclohexyl methacrylate, cyclohexyl acrylate and combinations thereof. Other examples of the alkyl methacrylate monomer where the alkyl group contains from 7 to 15 carbon atoms (also called the "mid-cut" alkyl methacrylates), are 2-ethylhexyl acrylate (EHA), 2-ethylhexyl methacrylate, octyl methacrylate, decyl methacrylate, isodecyl methacrylate (IDMA, based on branched $(C_{10})$alkyl isomer mixture), undecyl methacrylate, dodecyl methacrylate (also known as lauryl methacrylate), tridecyl methacrylate, tetradecyl methacrylate (also known as myristyl methacrylate), pentadecyl methacrylate and combinations thereof. Also useful are: dodecyl-pentadecyl methacrylate (DPMA), a mixture of linear and branched isomers of dodecyl, tridecyl, tetradecyl and pentadecyl methacrylates; and lauryl-myristyl methacrylate (LMA), a mixture of dodecyl and tetradecyl methacrylates. Examples of alkyl methacrylate monomers where the alkyl group contains from 16 to 24 carbon atoms (also called the "high-cut" alkyl methacrylates), are hexadecyl methacrylate (also known as cetyl methacrylate), heptadecyl methacrylate, octadecyl methacrylate (also known as stearyl methacrylate), nonadecyl methacrylate, eicosyl methacrylate, behenyl methacrylate and combinations thereof.

Figure 2A:
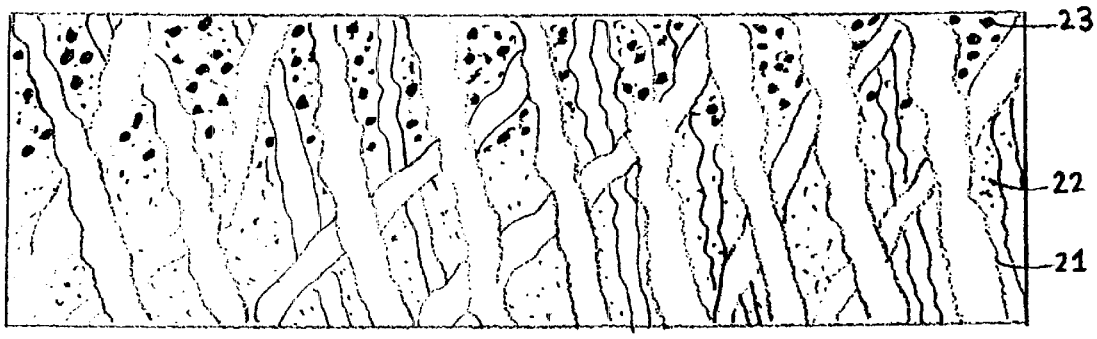
FIG. 2A is a cross section of an embodiment of the pad of this invention.

FIG. 2A is a cross-section of a pad of this invention made with a flexible substrate that is a felt. The felt is made of fibers 21, bonded together with a soft polymer 22. The hard polymeric material 23 is impregnated into the felt substrate.

Figure 2B:
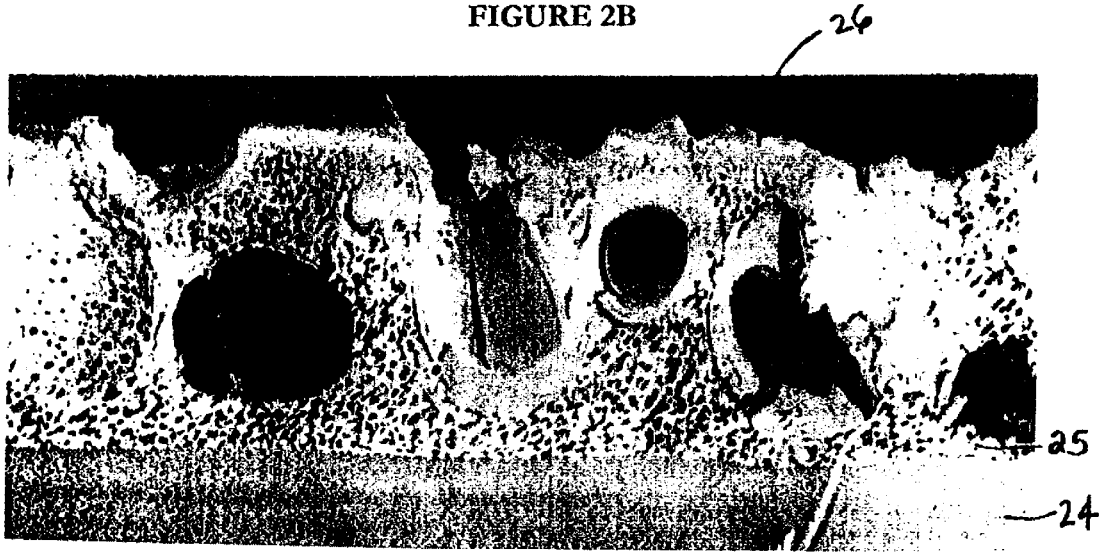
FIG. 2B is a cross section of an embodiment of the pad of this invention.

FIG. 2B is a cross-section of a pad of this invention made with a flexible substrate that is a polyester film. The polyester film 24 has the soft polymeric material 25 coagulated to form a layer with a porous structure. The hard polymeric material 26 is impregnated into the porous layer 25.

Figure 3:
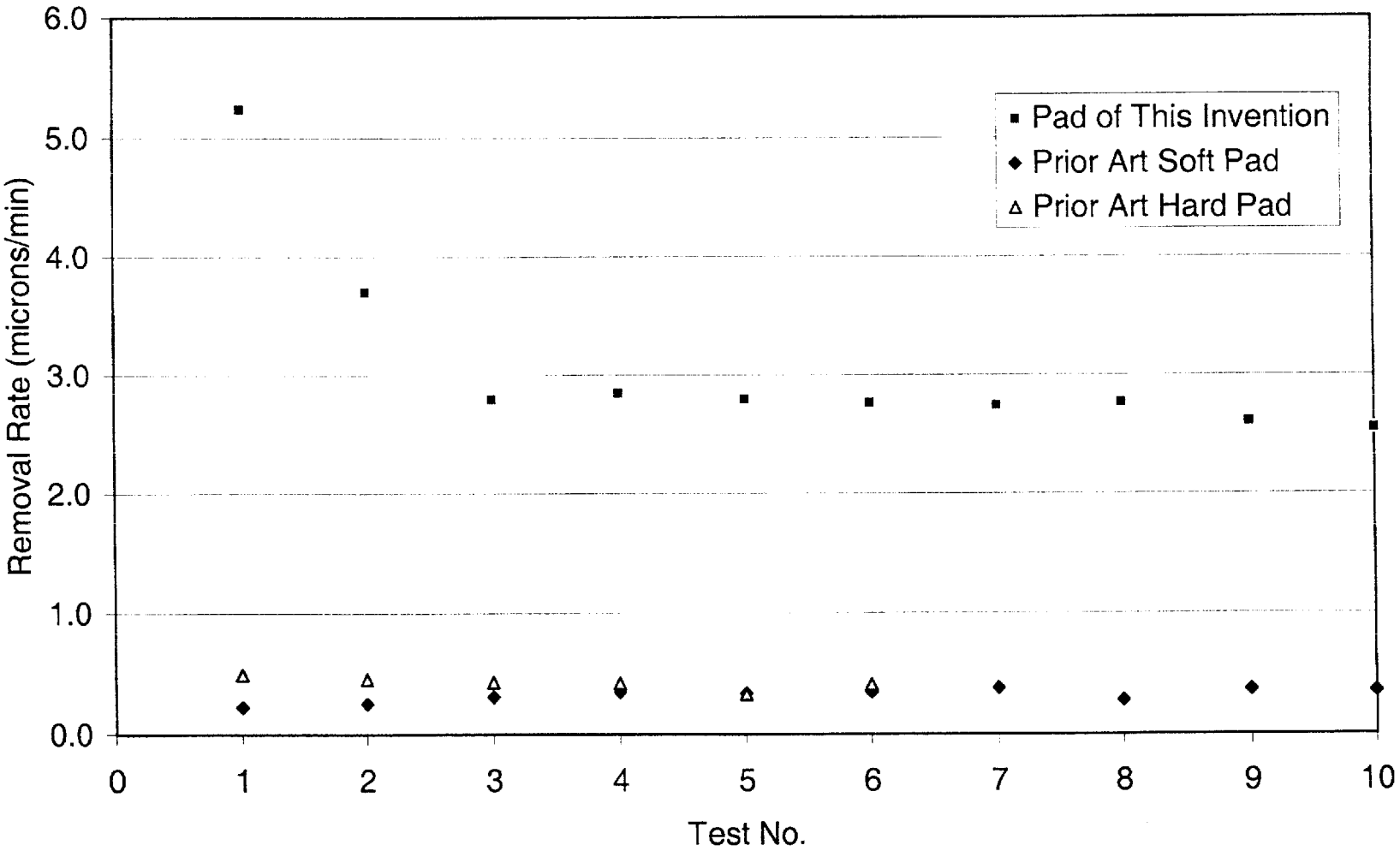
FIG. 3 is a graph comparing removal rates using a pad according to this invention and prior art pads.

FIG. 3 is a graph comparing removal rates using a pad according to this invention with removal rates observed using prior art soft and prior hard pads under identical test conditions.

In an embodiment, the pad of this invention is made by impregnating a fibrous felt web with a solution or colloidal dispersion including the desired elastomer, such as polyurethane. The polyurethane used for making pads of the present invention, utilizing a fibrous felt web substrate, has a viscosity of about 2,000 cps to about 18,000 cps, with a target viscosity of about 9,500 cps, all measured at 40° C. The urethane is dissolved in a solvent such as N,N-dimethyl formamide (DMF) for a solution solids content from about 5% to about 20%, with a target of about 12%. The fibrous felt web substrate is then saturated with a solution of urethane or urethane-polyvinyl chloride (PVC) blend in DMF. Saturation of the substrate is achieved by directing a continuous felt web into a vessel containing the solution of urethane or urethane-PVC blend in DMF at 49° C. for about three to five minutes. The felt web is allowed to float on top of the solution contained in an elongated vessel so that the solution is wicked into the felt. The elastomer is then cured by the method steps of coagulation, leaching and drying.

Coagulation of the elastomeric polymer occurs when the impregnated felt web is bathed in a non-solvent (for e.g. water) which is at least partially miscible with the solvent (for e.g. DMF). The exchange of the non-solvent for the solvent precipitates the polymer to form a porous structure.

The coagulation of the elastomeric polymer being impregnated into the felt web is non-uniform. Thus, pore size will vary gradually from the top to the bottom of the impregnated web. Pore size can be controlled to produce a relatively precise average pore size so that polishing abrasives used in polishing slurries can be matched to the pore size of the porous elastomer. As described in U.S. Pat. No. 3,284,274, the pore size during the coagulation step may be controlled by the relative percentages of solvent and non-solvent in the coagulation bath and the temperature of the coagulation bath.

The coagulation rate, and therefore the pore size, can also be controlled by using accelerators such as colloidal silica, carbon black or polymers having a higher molecular weight than the basic elastomer, for example high molecular weight PVC (about 5% to about 40%). These additives cause rapid precipitation of the polymer to form small pores. Certain inhibitors slow the precipitation to form larger pores, such as methanol or ethanol (about 1% to about 10%), salts (for e.g. sodium chloride or potassium chloride), or polymers having a lower molecular weight than the basic elastomer, for example, a low molecular weight PVC, or even lower molecular weight polyurethanes. U.S. Pat. No. 4,511,605 describes a process for producing polishing pads by fully impregnating a fibrous batt with an aqueous polyurethane dispersion, coagulating the polyurethane dispersion, and drying the impregnated batt. The patent also describes the addition of colloidal silica to the polyurethane dispersion to increase the density of the impregnated material.

Any free solvent and non-solvent remaining after the coagulation step is removed by squeezing the felt web followed by drying in an oven at about 90 to 120° C. for about 5 to 20 minutes. The resultant impregnated felt web is then buffed, and rolled, for final coating or impregnation with a hard friable polymeric material. The final coating or impregnation step is followed by drying at 90 to 120° C. for about 5 to 20 minutes. The pad formed by the above process is then cut to size and a pressure sensitive sheet adhesive applied to the flexible substrate side of the pad. The pressure sensitive sheet adhesive enables mounting of the pad to the polishing platen of a polishing machine used to polish semiconductor substrates by known CMP.

In an embodiment, a flexible substrate (polyester film) is coated with a polyurethane or a polyurea to a wet coating thickness in a range of about 600 to about 1200 $\mu$m. The coated substrate is then passed into an aqueous bath that contains about 10 to about 20% dimethylformamide (DMF) by weight to coagulate the polyurethane or polyurea into a porous structure. The coated substrate is then dried in an oven at about 90 to 120° C. for about 8 to about 10 minutes to remove residual solvent and water. The surface layer of the porous structure is then buffed to obtain a layer of uniform thickness. A liquid composition of the hard polymeric material, such as an aqueous-based latex or polyurethane/polyacrylate dispersion, is then applied to the porous layer by coating or impregnation. The hard polymeric material penetrates the porous layer to some extent and the pad is dried at about 90 to about 120° C. for about 8 to 10 minutes to remove residual solvent and water. The pad formed by the above process is then cut to size and a pressure sensitive sheet adhesive applied to the flexible substrate side of the pad. The pressure sensitive sheet adhesive enables mounting of the pad to the polishing platen of a polishing machine used to polish semiconductor substrates by known CMP.

A method is also provided for chemical-mechanical polishing of various substrates utilizing a polishing pad according to this invention. In chemical-mechanical polishing of semiconductor substrates, the substrate is pressed against a polishing pad and a polishing fluid or slurry is provided at the interface between the substrate and the polishing pad while the polishing pad and the substrate are moved relative to each other under pressure. Polishing pressure or downforce controls the polishing rate or the material removal rate from the substrate being polished. A higher downforce results in faster material removal rate from the substrate with scratching while a lower downforce yields lower material removal rates but a polished surface of better quality since the abrasive particles in the slurry do not scratch the substrate surface to the same extent at lower downforce values as at higher downforce values. During CMP, the substrate (for e.g. glass disks, semiconductor wafers, multi-chip modules or printed circuit boards) to be polished is mounted on a carrier or polishing head of the polishing apparatus. The exposed surface of the substrate is then placed against the rotating polishing pad. The carrier head provides a controllable pressure (or downforce), on the substrate to push it against the polishing pad. A polishing fluid with or without abrasive particles is then dispensed at the interface of the substrate and the polishing pad to enhance material removal from the substrate surface. Typical downforce values during CMP are in a range of about 0.7 kPa to about 70 kPa.

EXAMPLES

The following examples illustrate embodiments of the pad according to this invention. All percentages are on a weight basis unless otherwise indicated.

Example 1

A needle punched felted web of polyester fibers was prepared in the manner of Example 1 of U. S. Pat. No. 3,067,482, Column 4, lines 1 through 57, except that sufficient fiber was used to produce a web thickness of 0.5 centimeters. This felt web was then impregnated with a 20% solids solution of polyurethane elastomer as described in Example 1 of U.S. Pat. No. 3,067,482 (referred to herein as the first solution). Separately, 20 parts by weight of Estane 5707 (a polyurethane resin manufactured by B. F. Goodrich) was dissolved in 80 parts by weight DMF, referred to herein as the second solution. The impregnating solution was made by mixing 15 parts of the first solution with 83 parts of the second solution and 2 parts water. The impregnated web was then coagulated, washed and dried as described in the referenced patent. The resulting web exhibited a skin of coagulated urethane on its top and bottom surfaces. The web was further split into two 0.1-inch thick webs and the skin removed by skiving. The web was then impregnated a second time with an aqueous acrylic solution containing 25% solids and dried. After drying, the material was processed by buffing to smooth and condition the surface.

The pad thus prepared was then used to polish glass disks. A LECO AP300 polisher using a down force of 50 psi, and a platen speed of 400 rpm was used for all polishing tests. The average duration of each polishing test was 10 min. Ultrasol 1000 (a slurry marketed by Solutions Technology, Inc., a subsidiary of Rodel, Inc.) was used at a flow rate of 50 ml/min for all polishing tests. Ultrasol 1000 is a ultra-high purity ceria-based slurry. Table 1 compares the polishing data obtained using the pad of this invention and two pads manufactured by Rodel, Inc., based in Delaware, USA. IC 1000XYKA2 is a molded polyurethane pad with grooves (Prior Art Hard Pad) while DPM 1000 comprises a coagulated polyurethane coated on a polyester substrate (Prior Art Soft Pad).

The roughness data presented in Table 1 for the pad of this invention were obtained from areas of the glass disk that were completely cleared of pre-polish roughness or damage. The pad of this invention yielded improved roughness and better surface quality over the hard pad and improved waviness and better surface quality over the soft pad.

FIG. 3 is a comparison of removal rates obtained using the pad of this invention and the two prior art pads. Each point on the graph represents a polishing test conducted on a glass disk under identical test conditions.

TABLE 1

| Pad | Roughness (Angstroms) | Waviness (Angstroms) | Ia (Angstroms) | Notes |
|---|---|---|---|---|
| This Invention | 5.8 | 9.4 | 11.4 | Complete Polish |
| DPM 1000 | 3.4 | 10.6 | 11.6 | Incomplete Polish |
| IC 1000 XYKA2 | 6.1 | 4.0 | 7.6 | Scratches; Incomplete Polish |

Notes:
Average values for a scan area of 0.7 × 0.5 mm and a magnification of 10x are provided.
All measurements were taken using a Zygo (Newview 100) interferometer.
Ia is the surface roughness without any filtering (i.e., it is the Ra and Wa combined).
An incomplete polish means that not all of the incoming or pre-polish surface roughness was removed because the removal rate was too low. An incomplete polished surface can affect the roughness measurements.

Example 2

A polishing pad according to this invention was prepared by extrusion coating a polyethylene terephthalate (PET) film with a thickness in a range of about 180 to 190 $\mu$m. The PET film was precoated with an adhesion promoter to ensure adequate coating of the PET film. The coating applied to the PET film comprised a polyurethane solution in DMF along with coloring agents, and a surfactant. The polyurethane was formed by reacting ethylene glycol, 1,2 propylene glycol, 1,4 butanediol, and 4,4 diphenylmethane diisocyanate. After extrusion coating the film was passed repeatedly (about two to three times) through a water/DMF bath containing about 10 to 20% by weight DMF to ensure coagulation of the polyurethane. The coated film was then dried in an oven at 105° C. for about 8–10 minutes. After drying, the material was buffed until a coating thickness of about 500 to 625 $\mu$m was achieved. The buffed material was then dipped in an aqueous polyurethane/polyacrylate dispersion (15–35% solids) and a surfactant (cocamidopropyl betaine at about 1.5% by weight) for about 4 to 5 minutes. The material was then rapidly dried at about 120 to 170° C. Pressure sensitive adhesive was applied to the unbuffed side of the pad to enable mounting of the pad to the polishing platen of a polishing machine used in known CMP.

Polishing pad samples made according to the process of this example were then hand laminated to the platen of a Speedfam SPAW 50 polisher. The down force of the polisher was set to 6 psi with a platen speed of 13 rpm. Silicon wafers were then polished using Nalco 2354 slurry (diluted at 20:1). Nalco 2354 slurry is a colloidal silica slurry with a pH of about 10.5. The slurry flow rate was set at 700 ml/min. For comparative purposes, a prior art hard pad (MHS15A, manufactured by Rodel-Nitta, Inc. based in Nara, Japan) and a prior art soft pad (SUBA 850 manufactured by Rodel, Inc. based in Newark, Del.) were also tested under identical conditions. All measurements were taken using a Zygo (Newview 100) interferometer. The various test results are summarized in the following table.

| Parameter | Prior Art Hard Pad | Prior Art Soft Pad | Pad of this Invention |
|---|---|---|---|
| Substrate | Silicon Wafer | Silicon Wafer | Silicon Wafer |
| Average RMS (Angstroms) | 14.05 | 12.44 | 10.21 |
| Average Dub Off (Peak) (microns) | 0.123 | 0.197 | 0.063 |
| Average Dub Off (Radius of Curvature)(meters) | 2.01 | 1.95 | 3.53 |
| Average Removal Rate (microns per minute) | 0.42 | 0.45 | 0.50 |

A primary advantage of the pad of this invention over prior art polishing pads is improved dub-off. This invention results in an average dub-off (peak) measurement of 0.123 $\mu$m and an average dub-off (RadCurve) of 3.53 $\mu$m, which is a significant improvement over prior art pads. Thus, the pad of this invention results in a flatter polished substrate surface.

What is claimed is:

1. A polishing pad comprising;

a soft porous layer having an upper surface, the upper surface having peaks and valleys; and a hard material impregnated in the soft porous layer, the hard material being friable for breaking down in peaks of the upper surface of the porous layer during polishing to reduce form error in the upper surface of the soft porous layer.

2. The polishing pad of claim 1 wherein the hard material is selected from the group of materials consisting of polymers, ceramics, inorganic oxides, nitrides, carbides, diamond, metal oxides, metal powders and combinations or mixtures thereof.

3. The polishing pad of claim 1 wherein the hard material is a polymeric material having a glass transition temperature between 25 and 175° C.

4. The polishing pad of claim 1 wherein the soft porous layer is selected from the group of materials consisting of polyurethane, polyurea and fibrous felt.

5. The polishing pad of claim 1 wherein the soft porous layer includes a flexible substrate supporting the soft porous layer.

6. A method of forming a polishing pad, comprising the steps of:

providing a soft porous layer having an upper surface, the upper surface having peaks and valleys: and impregnating the soft porous layer with a hard material, the hard material being friable and being adapted to break down in the peaks of the soft porous layer when the soft porous layer.

7. The method of claim 6 further including the step of subjecting the soft porous layer to polishing pressure to break down the bard material in peaks of the soft porous layer to reduce form error in the upper surface of the soft porous layer.

8. The method of claim 6 including the step of forming the soft porous layer on a flexible substrate.

9. The method of claim 6 wherein the impregnating the soft porous layer with the hard friable material includes applying a liquid composition of a hard polymeric material to the soft porous layer.

10. The polishing pad of claim 6 wherein the hard material impregnated is a polymeric material having a glass transition temperature between 25 and 175° C.

* * * * *